US009222482B2

(12) United States Patent
Huang et al.

(10) Patent No.: US 9,222,482 B2
(45) Date of Patent: Dec. 29, 2015

(54) CENTRIFUGAL FAN

(75) Inventors: Yu-Nien Huang, Taoyuan County (TW); Chun-Fa Tseng, Kaohsiung (TW); Chun-Che Chiu, New Taipei (TW); Hsin-Yu Wang, Kaohsiung (TW); Yi-Mei Chiu, Taoyuan County (TW); Ching-Tzu Huang, Taoyuan County (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 717 days.

(21) Appl. No.: 13/533,742

(22) Filed: Jun. 26, 2012

(65) Prior Publication Data

US 2013/0216369 A1 Aug. 22, 2013

(30) Foreign Application Priority Data

Feb. 20, 2012 (TW) ..... 101105464 A

(51) Int. Cl.
*F04D 17/16* (2006.01)
*F04D 29/28* (2006.01)
*F04D 29/30* (2006.01)

(52) U.S. Cl.
CPC ..... *F04D 29/281* (2013.01); *F04D 29/30* (2013.01)

(58) Field of Classification Search
CPC ..... F04D 25/0613; F04D 29/281
USPC ..... 416/196 R, 195, 196 A, 203, 228, 235, 416/238, 223 B, 234
See application file for complete search history.

(56) References Cited

U.S. PATENT DOCUMENTS

| | | | | |
|---|---|---|---|---|
| 4,515,527 | A * | 5/1985 | Baker | 416/184 |
| 6,451,080 | B1 * | 9/2002 | Rocklitz et al. | 55/404 |
| 8,647,051 | B2 * | 2/2014 | O'Connor et al. | 415/102 |
| 2002/0057965 | A1 * | 5/2002 | Huang et al. | 415/98 |
| 2009/0311093 | A1 * | 12/2009 | Otsuki et al. | 415/203 |

FOREIGN PATENT DOCUMENTS

| | | |
|---|---|---|
| JP | 2-107790 | 8/1990 |
| JP | U3081775 | 11/2001 |
| JP | U3084210 | 3/2002 |
| JP | 2008-157216 | 7/2008 |
| JP | 2008-185000 | 8/2008 |

* cited by examiner

*Primary Examiner* — Igor Kershteyn
*Assistant Examiner* — Woody A Lee, Jr.
(74) *Attorney, Agent, or Firm* — Rabin & Berdo, P.C.

(57) ABSTRACT

A centrifugal fan includes a housing, a driving device, and a fan impeller. The housing has a hollow chamber which has a central axis. The driving device is located at the central axis of the hollow chamber. The fan impeller is disposed in the hollow chamber and includes a hub, several blades, and several fins. The hub is connected with the driving device. The blades are disposed around the hub. Each blade has a windward surface and a leeward surface. Each fin extends from the windward surface of one of the blades, outward by an arc surface from the windward surface starting from a location near the central axis, and further extends to the leeward surface of an adjacent blade.

10 Claims, 7 Drawing Sheets
(1 of 7 Drawing Sheet(s) Filed in Color)

CENTRIFUGAL FAN

RELATED APPLICATIONS

This application claims priority to Taiwan Application Serial Number 101105464, filed Feb. 20, 2012, which is herein incorporated by reference.

BACKGROUND

1. Field of Invention

The present invention relates to a fan. More particularly, the present invention relates to a centrifugal fan.

2. Description of Related Art

Electric apparatuses, such as notebook computers, generate heat when operating. If the heat is not dissipated efficiently, the electric apparatuses may malfunction. In serious situations, the heat may damage electric elements in the electric apparatuses. Furthermore, burning electric elements may hurt users. One method for reducing the heat in electric apparatuses involves the use of centrifugal fans therein. Each centrifugal fan may include impellers and a driving device. Heat generated by operation of the electric elements may be dissipated by airflow generated by the centrifugal fans.

Known technology related to centrifugal fans used to solve the problem of poor air convection in the narrow hollow chamber of a notebook computer involves utilizing the shape of the housing to produce high pressure and rotation speed. However, Blade Pass Frequency (BPF) noise is produced by the centrifugal fan when wake flow is produced as a result of the blades hitting the tongue-shaped areas of the housing.

Recently, a ring-shaped centrifugal fan is used to reduce BPF noise. However, such a ring-shaped centrifugal fan needs to be improved to further reduce BPF noise and to realize greater airflow.

Therefore, there is a need to develop a centrifugal fan that can avoid the foregoing disadvantages.

SUMMARY

According to one aspect of the present disclosure, a centrifugal fan is provided. The centrifugal fan comprises a housing, a driving device, and a fan impeller. The housing has a hollow chamber which, in turn, has a central axis. The driving device is located at the central axis of the hollow chamber. The fan impeller is disposed in the hollow chamber of the housing. The fan impeller comprises a hub connected with the driving device; a plurality of blades disposed around the hub, in which each of the blades has a windward surface and a leeward surface; and a plurality of fins, each fin extending from the windward surface of one of the blades, extending outward along an arc surface from the windward surface of the one of the blades starting from a location near the central axis, and further extending to the leeward surface of an adjacent one of the blades.

In one embodiment, each fin is located at a middle position of and perpendicular to the one of the blades.

In one embodiment, each fin has an airfoil cross-section.

In one embodiment, the airfoil section is an NACA0012 section.

In one embodiment, an included angle between a tangent line to an outer edge of the each fin at a point of the outer edge that contacts the leeward surface of the adjacent one of the blades, and a tangent line to the leeward surface of the adjacent one of the blades at a point of the leeward surface where the outer edge contacts the leeward surface ranges from about 85° to about 90°.

In one embodiment, an included angle between a tangent line to the arc surface of the each fin at a point of the arc surface that contacts the leeward surface of the adjacent one of the blades, and a tangent line to the leeward surface of the adjacent one of the blades at a point of the leeward surface where the arc surface contacts the leeward surface ranges from about 76° to about 89°.

In one embodiment, when a radius of the fan impeller is measured from the central axis of the hollow chamber to an extreme distal end of any one of the blades, a vertical length from the arc surface of the each fin to the windward surface of the one of the blades ranges from about 0.2 mm to about 0.6 mm when the line forming the vertical length is drawn perpendicular to the windward surface and at a point of the windward surface that is about 0.58 times to about 0.61 times the radius of the fan impeller.

In one embodiment, when a radius of the fan impeller is measured from the central axis of the hollow chamber to an extreme distal end of any one of the blades, a vertical length from the arc surface of the each fin to the windward surface of the one of the blades ranges from about 0.6 mm to about 2.1 mm when the line forming the vertical length is drawn perpendicular to the windward surface and at a point of the windward surface that is about 0.72 times to about 0.75 times the radius of the fan impeller.

In one embodiment, a straight-line distance from the central axis to the point of the arc surface of the each fin that contacts the leeward surface of the adjacent one of the blades is about 0.85 times to 0.87 times the radius of the fan impeller.

In one embodiment, a straight-line distance from the central axis to the point of the outer edge of the each fin that contacts the leeward surface of the adjacent one of the blades is about 0.92 times to about 0.94 times the radius of the fan impeller.

Thus, the centrifugal fan herein not only generates more airflow but also reduces Blade Pass Frequency (BPF) noise.

BRIEF DESCRIPTION OF THE DRAWINGS

The patent or application file contains at least one sheet of drawings executed in color. Copies of this patent or patent application publication with color drawings will be provided by the Office upon request and payment of the necessary fee.

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
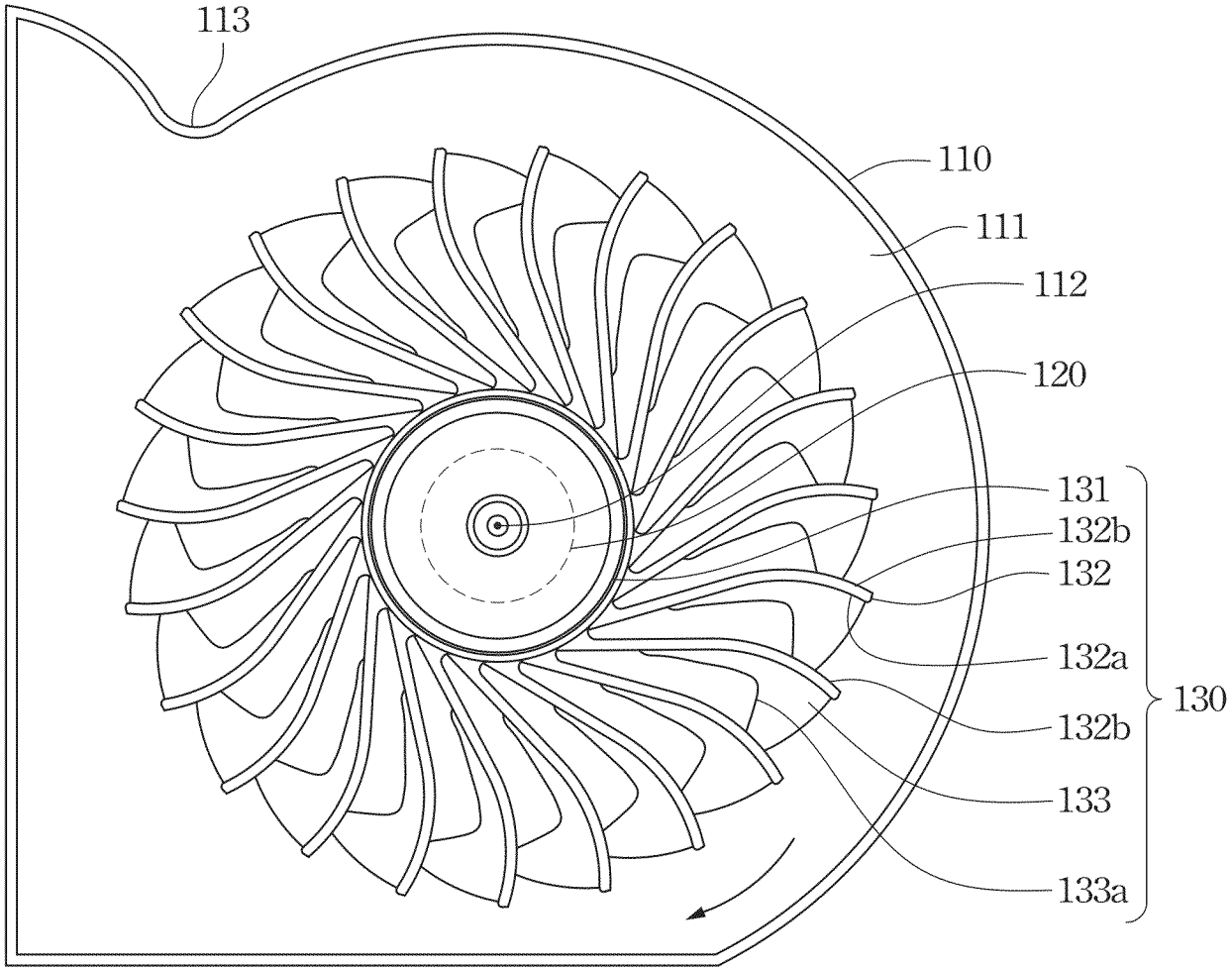
FIG. 1 illustrates a top view of a centrifugal fan according to an embodiment of the present invention, in which an upper cover part of a housing has been removed.

FIG. 1 shows a top view of a centrifugal fan 100 according to an embodiment of the present invention, in which an upper cover part of a housing 110 has been removed. The centrifugal fan 100 includes the housing 110, a driving device 120, and a fan impeller 130.

The housing 110 has a hollow chamber 111 which has a central axis 112. The housing 110 has a tongue 113. The fan impeller 130 is disposed in the hollow chamber 111 of the housing 110. The driving device 120 is located at the central axis 112 of the hollow chamber 111. The fan impeller 130 is disposed in the hollow chamber 111 and includes a hub 131, several blades 132, and several fins 133. The hub 131 is connected with the driving device 120. The blades 132 are disposed around the hub 131, and each of the blades 132 has a windward surface 132*a* and a leeward surface 132*b*. In this embodiment, the fan impeller 130 turns clockwise.

Each of the fins 133 extends from the windward surface 132*a* of one of the blades 132. Continuing the explanation with the same fin 133, the each fin 133 extends outward along an arc surface 133*a* from the windward surface 132*a* of the one of the blades 132 and starting from a location near the central axis 112, and further extends to the leeward surface 132*b* of an adjacent one of the blades 132 and is connected to the leeward surface 132*b*.

The intake of air occurs at a side of the centrifugal fan 100 that is perpendicular to the central axis 112, and the air enters the hollow chamber 111 and is blown out in the radial direction.

Figure 1A:
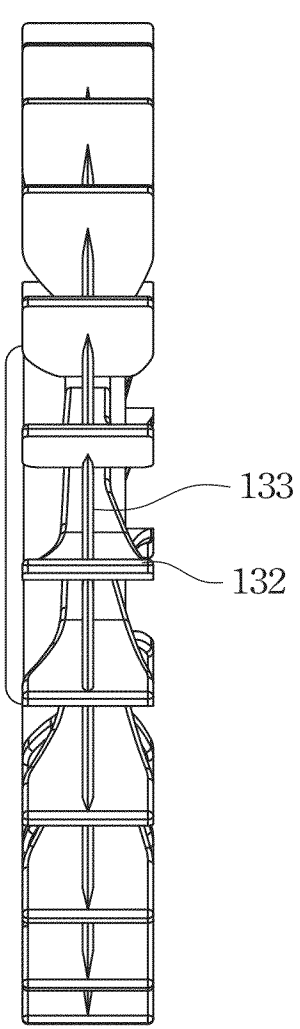
FIG. 1A illustrates a lateral view of a fan impeller of the centrifugal fan according to an embodiment of the present invention.

FIG. 1A shows a lateral view of the fan impeller 130 of the centrifugal fan 100 according to an embodiment of the present invention. Each fin 133 is located at a middle position of one of the blades 132 and perpendicular to the one of the blades 132. Each of the fins 133 has an airfoil cross-section. In this embodiment, the airfoil cross-section is an NACA0012 section so as to increase stable airflow. In other embodiments, the airfoil cross-section of each fin 133 can be other airfoil cross-sections having the same function.

Figure 2:
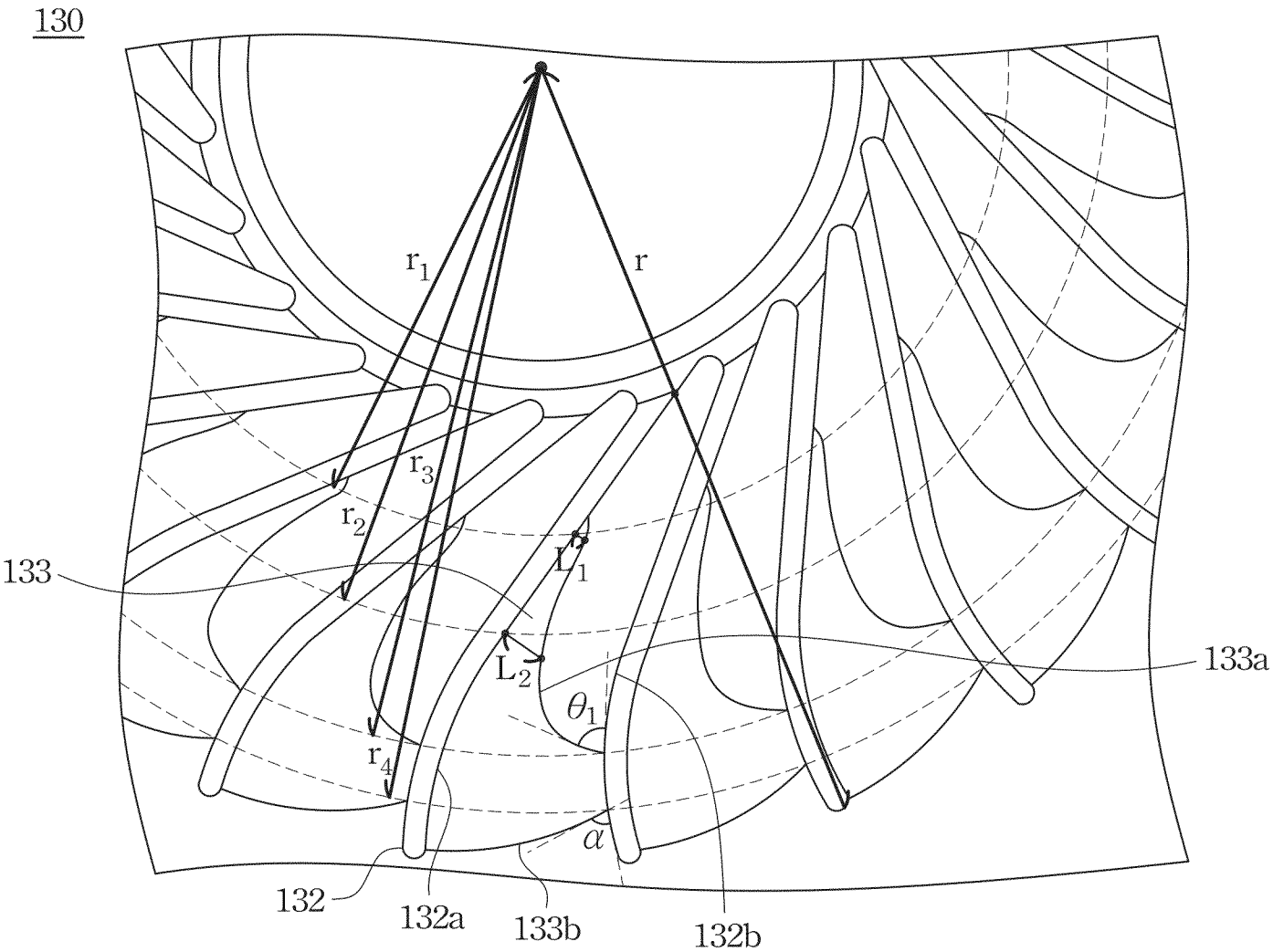
FIG. 2 is a partial schematic view of the fan impeller of the centrifugal fan according to an embodiment of the present invention, in which various dimensions of the fan impeller have been indicated.

FIG. 2 is a partial schematic view of the fan impeller 130 of the centrifugal fan 100 according to an embodiment of the present invention, in which various dimensions of the fan impeller 130 have been indicated. In this embodiment, Computational Fluid Dynamics (CFD) modeling is used to obtain a shape of the fan impeller 130. An included angle $\alpha$ between a tangent line to an outer edge 133*b* of each fin 133 at a point of the outer edge 133*b* that contacts the leeward surface 132*b* of an adjacent one of the blades 132, and a tangent line to the leeward surface 132*b* of the adjacent one of the blades 132 at a point of the leeward surface 132*b* where the outer edge 133*b* contacts the leeward surface 132*b* ranges from about 85° to about 90°. Moreover, an included angle $\theta_1$ between a tangent line to the arc surface 133*a* of the each fin 133 at a point of the arc surface 133*a* that contacts the leeward surface 132*b* of the adjacent one of the blades 132, and a tangent line to the leeward surface 132*b* of the adjacent one of the blades 132 at a point of the leeward surface 132*b* where the arc surface 133*a* contacts the leeward surface 132*b* ranges from about 76° to about 89°.

Additionally, when a radius r of the fan impeller 130 is measured from the central axis 112 of the hollow chamber 111 of the housing 110 (see FIG. 1) to an extreme distal end of any one of the blades 132, a vertical length $L_1$ from the arc surface 133*a* of the each fin 133 to the windward surface 132*a* of the one of the blades 132 ranges from about 0.2 mm to about 0.6 mm when the line forming the vertical length $L_1$ is drawn perpendicular to the windward surface 132*a* and at a point of the windward surface 132*a* that is about 0.58 times to about 0.61 times the radius r of the fan impeller 130.

In addition, a vertical length $L_2$ from the arc surface 133*a* of the each fin 133 to the windward surface 132*a* of the one of the blades 132 ranges from about 0.6 mm to about 2.1 mm when the line forming the vertical length $L_2$ is drawn perpendicular to the windward surface 132*a* and at a point of the windward surface 132*a* that is about 0.72 times to about 0.75 times the radius r of the fan impeller 130.

Furthermore, a straight-line distance $r_3$ from the central axis 112 (see FIG. 1) to the point of the arc surface 133*a* of the each fin 133 that contacts the leeward surface 132*a* of the adjacent one of the blades 132 is about 0.85 times to 0.87 times the radius r of the fan impeller 130. Finally, a straight-line distance r4 from the central axis 112 (see FIG. 1) to the point of the outer edge 133*b* of the each fine 133 that contacts the leeward surface 132*a* of the adjacent one of the blades 132 is about 0.92 times to about 0.94 times the radius r of the fan impeller 130.

Basing on the above description, the shape and design of the fins 133 and the form of each arc surface 133*a* may be constructed. Therefore, the shape and design of the centrifugal fan 100 is able to increase airflow and decrease noise.

Figure 3:
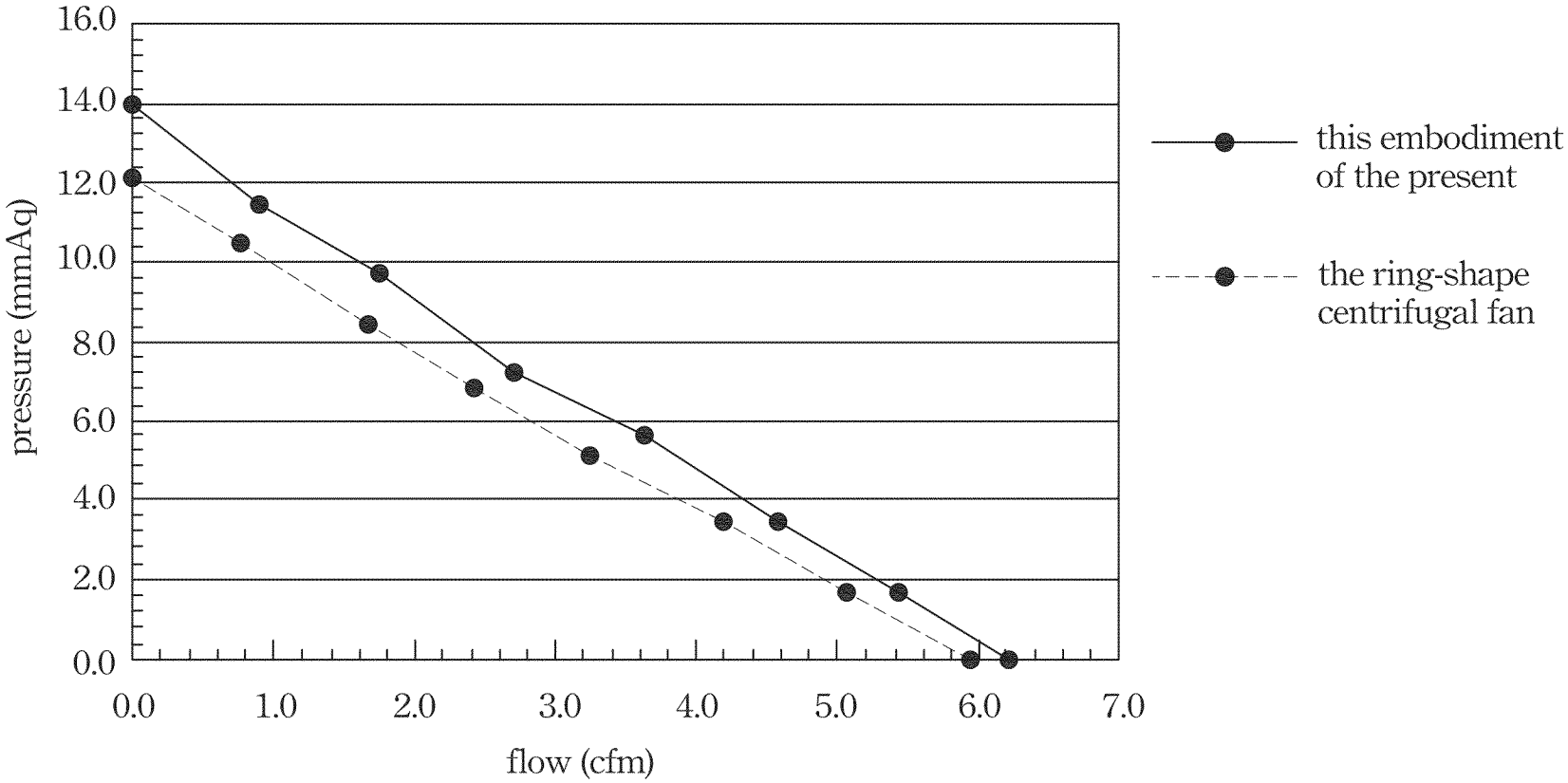
FIG. 3 illustrates a graph of a pressure-flow rate curve of the centrifugal fan according to an embodiment of the present invention.

FIG. 3 shows a graph of a pressure-flow rate curve of the centrifugal fan 100 (see FIG. 1) according to an embodiment of the present invention. The abscissa axis shows the air volume per minute and the ordinate axis shows the air pressure. The centrifugal fan 100 has a higher air pressure than the conventional ring-shaped centrifugal fan with the same air volume and a larger air volume than the conventional ring-shaped centrifugal fan with the same air pressure when the centrifugal fan 100 and the conventional ring-shaped centrifugal fan use the same size housing and fan impeller.

Figure 4A:
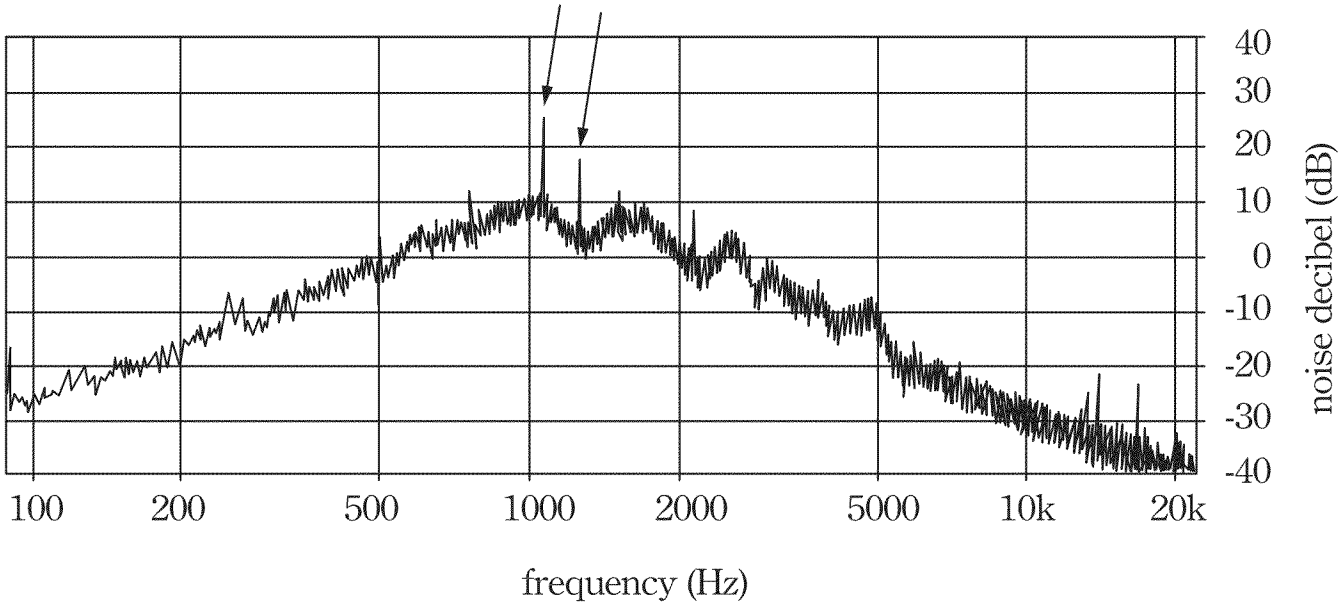
FIG. 4A illustrates a frequency spectrum of the conventional ring-shaped centrifugal fan.
Figure 4B:
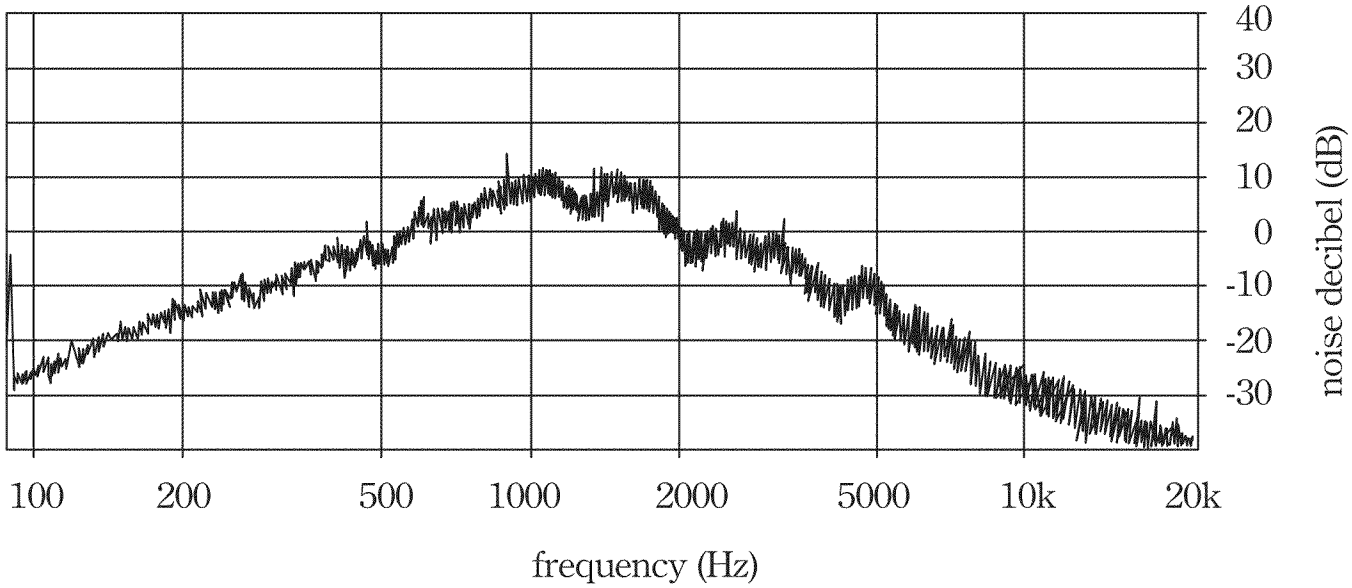
FIG. 4B illustrates a frequency spectrum of the centrifugal fan according to an embodiment of the present invention.

FIG. 4A shows a frequency spectrum of the conventional ring-shaped centrifugal fan and FIG. 4B shows a frequency spectrum of the centrifugal fan 100 (see FIG. 1) according to an embodiment of the present invention.

As shown in FIG. 4A, the conventional ring-shaped centrifugal fan has a BPF noise in the operational frequency of about 1000 Hz~2000 Hz. As shown in FIG. 4B, the centrifugal fan 100 (see FIG. 1) reduces the BPF noise in the operational frequency of about 1000 Hz~2000 Hz. By the experimental results, the BPF noise of the conventional ring-shaped centrifugal fan is 38 dB and the BPF noise of the centrifugal fan 100 is 36 dB.

Figure 5B:
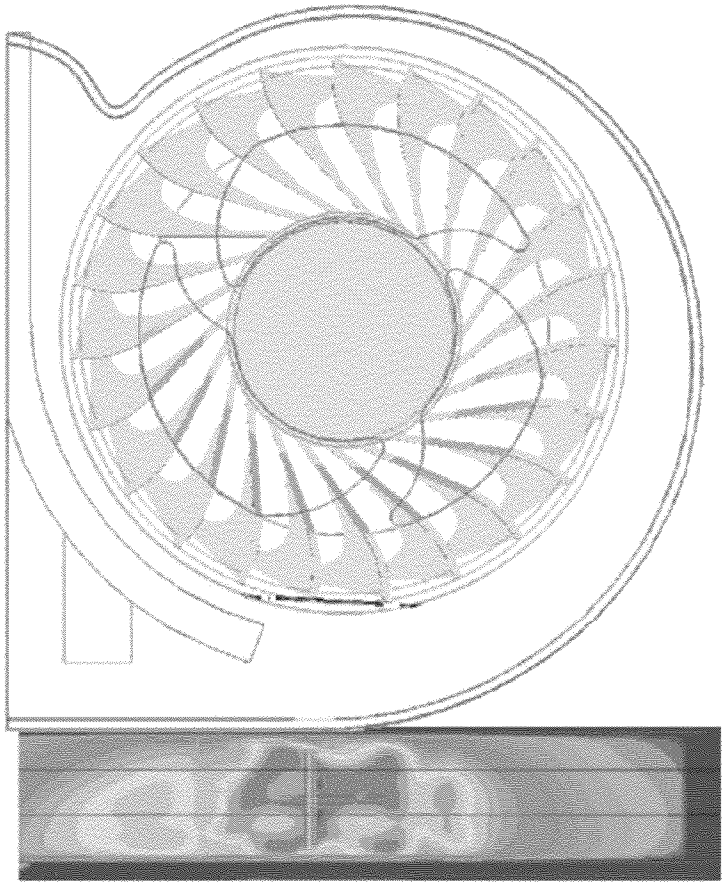
FIG. 5B is a schematic view illustrating air flow concentration of the centrifugal fan according to an embodiment of the present invention.
Figure 5A:
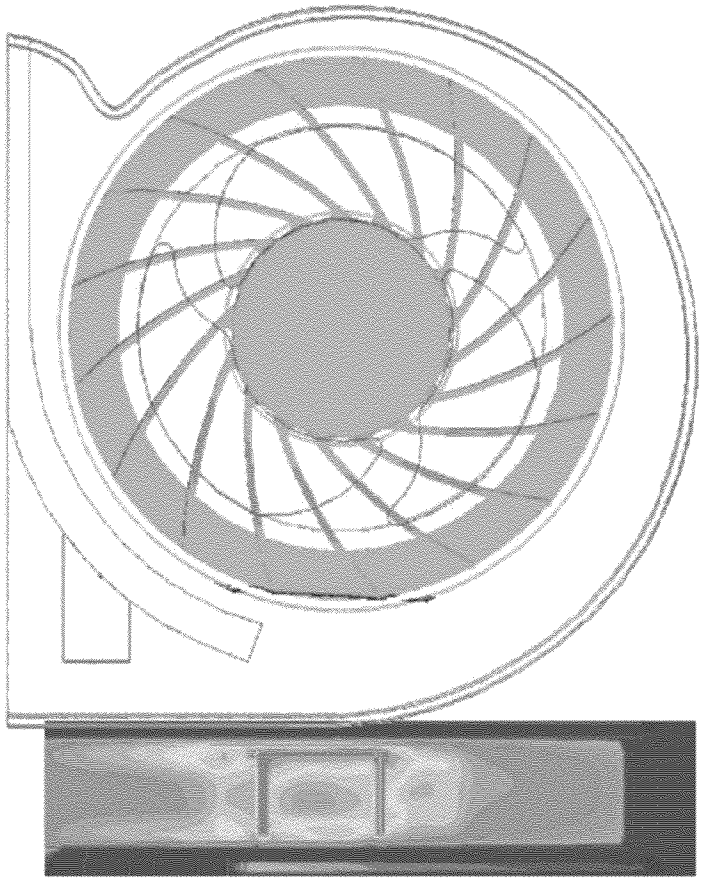
FIG. 5A is a schematic view illustrating air flow concentration of the conventional ring-shaped centrifugal fan.

FIG. 5A is a schematic view illustrating air flow concentration of the conventional ring-shaped centrifugal fan, and FIG. 5B is a schematic view illustrating air flow concentration of the centrifugal fan 100 (see FIG. 1) according to an embodiment of the present invention. Comparing FIG. 5A and FIG. 5B, the high-speed airflow of the centrifugal fan 100 is more concentrated than the conventional ring-shaped centrifugal fan.

According to above-discussed embodiments, the centrifugal fan of this disclosure generates a larger airflow than the conventional centrifugal fan through the design of the fan impeller. Moreover, the centrifugal fan of this disclosure minimizes BPF noise.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A centrifugal fan, comprising:

a housing having a hollow chamber, the hollow chamber having a central axis;

a driving device located at the central axis of the hollow chamber; and a fan impeller disposed in the hollow chamber of the housing, comprising:

a hub connected with the driving device;

a plurality of blades disposed around the hub, wherein each of the blades is directly connected to the hub, and each of the blades has a windward surface and a leeward surface; and a plurality of fins, each of the fins connecting the windward surface of one of the blades and the leeward surface of an adjacent one of the blades, and each of the blades being directly connected to two adjacent ones of the fins, wherein each of the fins is provided with an arc surface facing towards the hub, wherein one end of the arc surface is connected to the windward surface and is closer to the central axis than the other end of the arc surface which is connected to the leeward surface.

2. The centrifugal fan of claim 1, wherein each fin is located at a middle position of and perpendicular to one of the blades.

3. The centrifugal fan of claim 1, wherein each fin has an airfoil cross-section.

4. The centrifugal fan of claim 3, wherein the airfoil cross-section is an NACA0012 cross-section.

5. The centrifugal fan of claim 1, wherein an included angle between a tangent line to an outer edge of the each fin at a point of the outer edge that contacts the leeward surface of the adjacent one of the blades, and a tangent line to the leeward surface of the adjacent one of the blades at a point of the leeward surface where the outer edge contacts the leeward surface ranges from 85° to 90°.

6. The centrifugal fan of claim 1, wherein an included angle between a tangent line to the arc surface of the each fin at a point of the arc surface that contacts the leeward surface of the adjacent one of the blades, and a tangent line to the leeward surface of the adjacent one of the blades at a point of the leeward surface where the arc surface contacts the leeward surface ranges from 76° to 89°.

7. The centrifugal fan of claim 1, wherein, when a radius of the fan impeller is measured from the central axis of the hollow chamber to an extreme distal end of any one of the blades, a vertical length from the arc surface of the each fin to the windward surface of the one of the blades ranges from 0.2 mm to 0.6 mm when the line forming the vertical length is drawn perpendicular to the windward surface and at a point of the windward surface that is 0.58 times to 0.61 times the radius of the fan impeller.

8. The centrifugal fan of claim 1, wherein, when a radius of the fan impeller is measured from the central axis of the hollow chamber to an extreme distal end of any one of the blades, a vertical length from the arc surface of the each fin to the windward surface of the one of the blades ranges from 0.6 mm to 2.1mm when the line forming the vertical length is drawn perpendicular to the windward surface and at a point of the windward surface that is 0.72 times to 0.75 times the radius of the fan impeller.

9. The centrifugal fan of claim 1, wherein a straight-line distance from the central axis to the point of the arc surface of the each fin that contacts the leeward surface of the adjacent one of the blades is 0.85 times to 0.87 times the radius of the fan impeller.

10. The centrifugal fan of claim 1, wherein a straight-line distance from the central axis to the point of the outer edge of the each fin that contacts the leeward surface of the adjacent one of the blades is 0.92 times to 0.94 times the radius of the fan impeller.

* * * * *